United States Patent [19]

Bosworth

[11] 4,366,958

[45] Jan. 4, 1983

[54] RACKET STRINGING MACHINES

[75] Inventor: Warren Bosworth, Glastonbury, Conn.

[73] Assignee: Tennis Machines, Inc., St. Louis, Mo.

[21] Appl. No.: 161,670

[22] Filed: Jun. 23, 1980

[51] Int. Cl.[3] ..... A63B 51/14

[52] U.S. Cl. ..... 273/73 A; 269/98; 269/189; 269/204; 269/243

[58] Field of Search ..... 273/73 A; 403/343, 349; 269/90, 91, 101, 167, 189, 203, 204, 240–245, 97, 98

[56] References Cited

U.S. PATENT DOCUMENTS

| | | | |
|---|---|---|---|
| 1,042,610 | 10/1912 | Schulz | 273/73 A X |
| 1,518,316 | 12/1924 | Ellingham | 273/171 |
| 1,969,826 | 8/1934 | Tanber et al. | 273/73 A |
| 2,154,870 | 4/1939 | Serrano | 273/73 A |
| 2,246,109 | 6/1941 | Serrano | 273/73 A |
| 2,497,384 | 2/1950 | Young | 403/343 X |
| 3,441,275 | 4/1969 | Held | 273/73 A |
| 3,988,022 | 10/1976 | Halbrook | 273/73 A |
| 4,049,268 | 9/1977 | Ray | 273/73 A |

FOREIGN PATENT DOCUMENTS

| | | | |
|---|---|---|---|
| 855114 | 2/1940 | France | 273/73 A |
| 2327803 | 5/1977 | France | 273/73 A |
| 839443 | 6/1960 | United Kingdom | 273/73 A |

*Primary Examiner*—Anton O. Oechsle
*Attorney, Agent, or Firm*—Haverstock, Garrett & Roberts

[57] ABSTRACT

An apparatus for use in stringing rackets comprising a support structure including a pedestal having a base portion with a weighted foot pedal pivotally attached thereto, a racket supporting portion attached to the upper end of the support portion, a string clamp mechanism operatively connected to the foot pedal, the clamp mechanism including clamp members for engaging and clamping a length of string extending therebetween, a clamp support member mounted adjacent to the racket supporting portion, a string clamp assembly including a pair of members having portions for engaging a length of string extending therebetween, a member pivotally connecting the pair of members, a spring between the clamp members biasing said string engaging portions apart, and a clamp operator member movable between an open position whereby a length of string can be moved between the string engaging portions and a closed position in which the string engaging portions move into clamping positions. The subject improvements also reside in an improved string tension adjustment mechanism, a novel guide bar assembly for supporting the string clamp assemblies in different positions, a novel brake assembly for locking a racket in different positions relative to the string clamp mechanism, a novel racket engaging support structure including a quick operating racket clamp and racket release device therefor, and an optional modified clamp support structure which enables stringing rackets that have their crossed string reaches oriented at other than a right angle.

12 Claims, 8 Drawing Figures

RACKET STRINGING MACHINES

Many machines and apparatus have been devised for stringing rackets such as tennis rackets and the like, including the devices disclosed in Serrano U.S. Pat. Nos. 2,188,250 and 2,246,109 and in Halbrook U.S. Pat. Nos. 3,988,022 and 4,125,259. Other patents that disclose racket stringing machines that are of general interest include U.S. Pat. Nos. 1,962,865, 2,154,270, 2,262,110, 2,309,849, 2,971,760, 3,441,275, 3,511,502 and 3,635,080. Many of the known racket stringing machines have operated fairly satisfactorily and some have enjoyed wide usage. However, all known machines suffer from certain shortcomings and disadvantages particularly in the ease and quickness with which the reaches of string that extend across the racket are tensioned and then clamped to hold their tension, while the stringing operation proceeds, and with known stringing devices it has been difficult and time consuming to change from stringing in one direction across a racket to stringing in another direction thereacross because to do so has required time consuming changes in the operative positions of certain parts and assemblies including especially those parts and assemblies that clamp the reaches of string that extend across the frame of the racket. Furthermore, with the known machines it is difficult and time consuming to accurately change from one string tension to another. Also with known machines it has not been possible to string rackets other than those that have their crossed string reaches arranged in a right angle relationship, and also the means employed on known machines that support and clamp the racket during stringing have undesirably stressed the racket frames and have not provided the most desirable support therefor resulting in frequent racket damage. With the known devices it has also required considerable time to install and remove a racket from stringing position. The present racket stringing machine overcomes these and other disadvantages and shortcomings of known devices, and teaches the construction and operation of a novel racket stringing machine which has improved string clamping means, improved means for adjusting and changing the string tension, improved means for mounting a racket to be strung, and improved means for locking the racket being strung in different positions during stringing thereof. The present construction also includes means that enable the stringing of rackets where the crossed string reaches are at other than right angles.

It is therefore a principal object of the present invention to provide an improved racket stringing machine which is relatively simple to operate and has improved, easy to install and use, string clamping means to hold and maintain the tension on a reach of string during different portions of the stringing operation.

Another object is to make it easier and quicker to string a racket to a desired string tension.

Another object is to reduce the time and effort required to relocate the string clamp members used on a racket stringing machine.

Another object is to simplify and make the procedure for adjusting the tension of the string applied to a racket more accurate.

Another object is to enable the stringing of rackets that have their string reaches oriented at right angles as well as at other angular orientations.

Another object is to provide improved means to support a racket frame during stringing thereof.

Another object is to provide improved means to apply clamping pressure to a reach of string under tension to maintain the tension thereon.

Another object is to teach the use of quick release means for mounting and releasing a racket frame on a stringing apparatus.

Another object is to make the assembly, location and removal of a string clamping member easier and more convenient.

These and other objects and advantages of the present invention will become apparent after considering the following detailed specification in conjunction with the accompanying drawings wherein.

Figure 1:
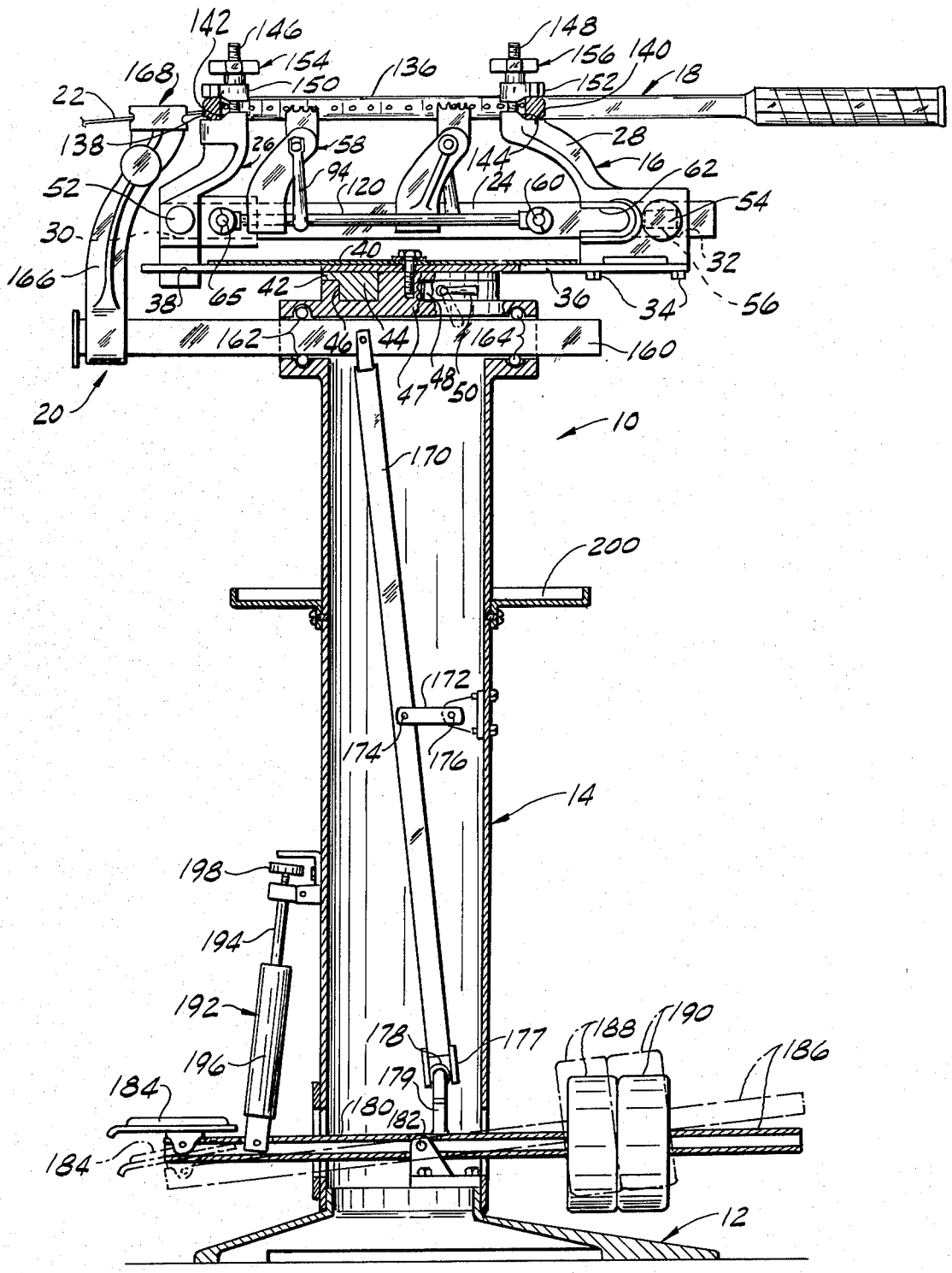
FIG. 1 is a side elevational view partly in cross-section of a racket stringing machine constructed according to the present invention.

Referring to the drawings more particularly by reference numbers, number 10 refers generally to a racket stringing machine constructed according to the present invention. The machine 10 includes a pedestal portion 12 connected to the lower end of an upright column 14, the upper end of which has means 16 to support a racket 18 during stringing, and other means 20 to tension string 22 as it is applied to the racket 18.

The means 16 to support the racket 18 include a bar 24 which has spaced racket support members 26 and 28 mounted thereon. The bar 24 is shown oriented horizontally and extends through aligned openings 30 and 32, respectively, in the support members 26 and 28. The support member 28 is connected by threaded members 34 to another horizontal bar 36 which extends across the top end of the column 14 and through an opening 38 in the support member 26. The bar 24 is oriented to have its wider dimension vertical while the wider dimension of the bar 36 is horizontal. An upper tray 40 is positioned extending over the bar 36 and outwardly in all directions from the column 14 to provide a convenient upper work surface immediately below where a racket is mounted. The bar 36 and the tray 40 are fixedly attached to a member 42 which has an annular depending flange portion 44. The flange 44 extends downwardly into an annular groove 46 in a member that forms the upper end portion 47 of the column 14. This enables the upper tray 40 and the racket supporting structure 16 to be rotated relative to the column 14 to any desired orientation. This is necessary to tension each new reach of string as it is applied to the racket.

The upper end of the column 14 also has provision for a locking shoe or brake member 48 which is threadedly or otherwise connected to a brake handle 50 which is movable to one position to free the shoe 48 from engagement with the annular flange 44 so that the racket support structure 16 can be rotated. In another position of the handle 50, the shoe 48 bears against the flange 44 to prevent rotation thereof, and to lock the racket support structure 16 and the racket 18 supported thereon against rotation. Locking and unlocking the racket support structure 16 can be done quickly and easily.

The racket support member 26 has a locking knob 52 which is threadedly attached thereto and can be rotated in one direction to lock the member 26 in fixed position on the bar 24. The position of the member 26 on the bar 24 will depend on the size and shape of the racket and particularly the frame portion thereof to be strung. The other racket support member 28 also has means including knob 54 for locking it in position on the bar 24. The knob 54 is threadedly connected to the member 28 and may include a shoe portion 56 which bears against the bar 24 in the locked position.

The bar 24 carries other members which are important to the stringing operation including members that are used to support string clamp assemblies 58 which are used to engage and clamp each reach of the string 22 as it is positioned and tensioned to retain preestablished tension thereon until the succeeding reach is applied and tensioned. The members that support the string clamp assemblies 58 include a first rod 60 which extends transversely through the bar 24 and from the opposite sides thereof. The rod 60 is fixedly attached to the bar 24, is oriented at right angles thereto, and is shown located on the bar 24 fairly near to the support 28. The support 28 is notched at 62 to enable the rod 60 to be positioned so as to accommodate many different sizes of rackets to be strung. The rod 60 in the construction as shown, however, is not positionally adjustable along the bar 24.

Figure 3:
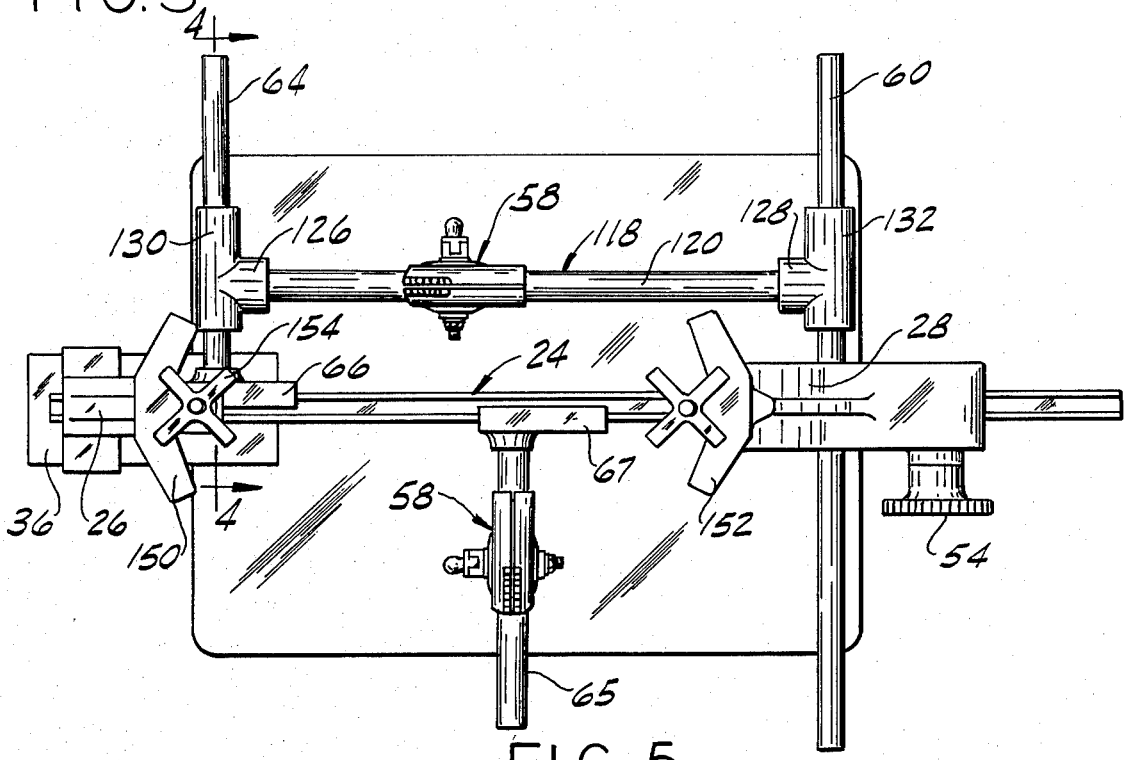
FIG. 3 is a top view of the same machine.
Figure 4:
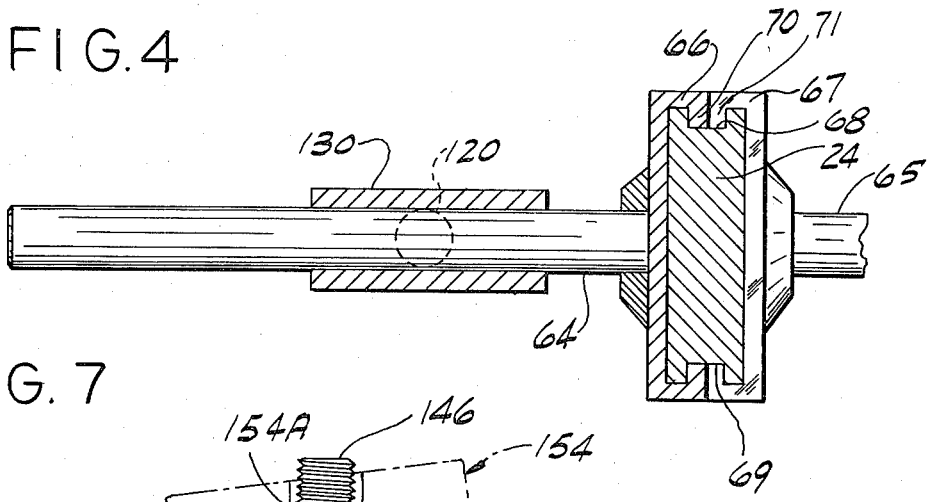
FIG. 4 is a fragmentary cross-sectional view taken on line 4—4 of FIG. 3.
Figure 8:
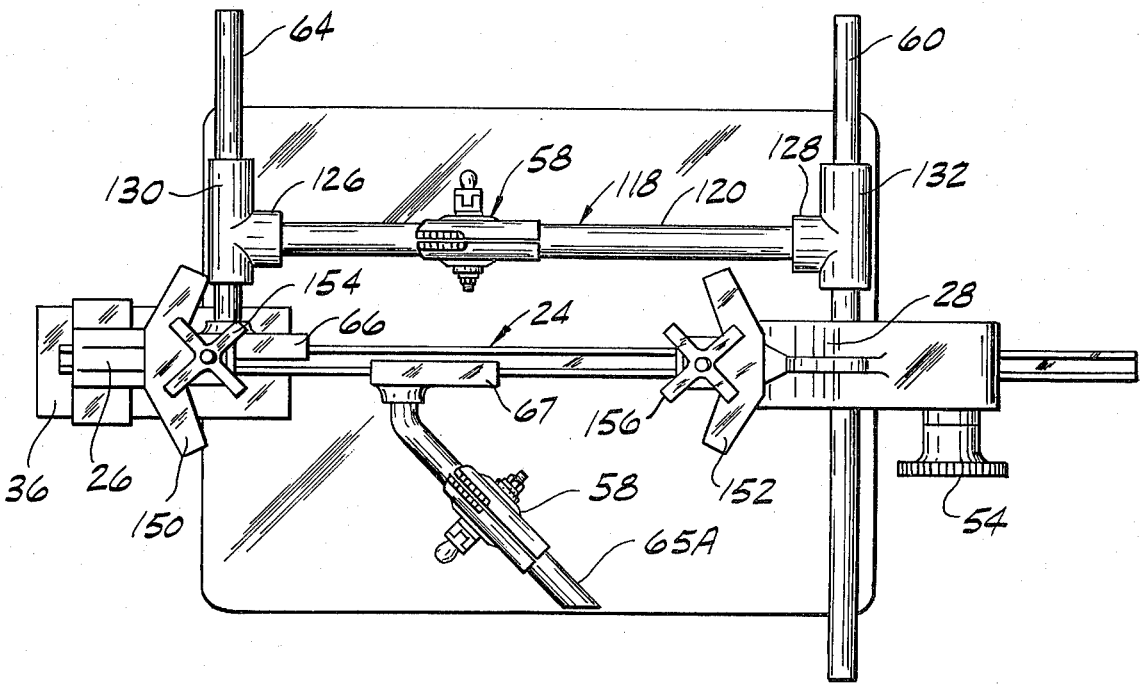

The bar 24 has other means thereon for supporting other rod members 64 and 65 which are also provided to support string clamp assemblies similar to the assembly 58. The rod members 64 and 65 are attached to respective slides 66 and 67 which are mounted for sliding movement along the bar 24 in the space between the supports 26 and 28. The bar 24 has longitudinally extending grooves 68 and 69 formed in the upper and lower edges thereof which slidably accommodate flanges 70 and 71 on the slides 66 and 67. The rod members 64 and 65 are attached to the respective slides 66 and 67 (FIGS. 3 and 4). and are usually oriented to extend from opposite sides of the bar 24 at right angles thereto and in parallel relation to the rod 60. It is anticipated, however, that the rods 64 and 65 can extend at some other angle usually toward the rod 60 relative to the bar 24 as shown in the modified construction at 65A of FIG. 8. This is done when the subject device is to be used to string rackets that have their crossed string reaches oriented at some angle other than a right angle. There are in existence a few such rackets that have non-perpendicular crossed string reaches although most rackets have perpendicular crossed string reaches. The present machine can therefore be used to string all known rackets regardless of the angular relation of the string reaches.

Figure 2:
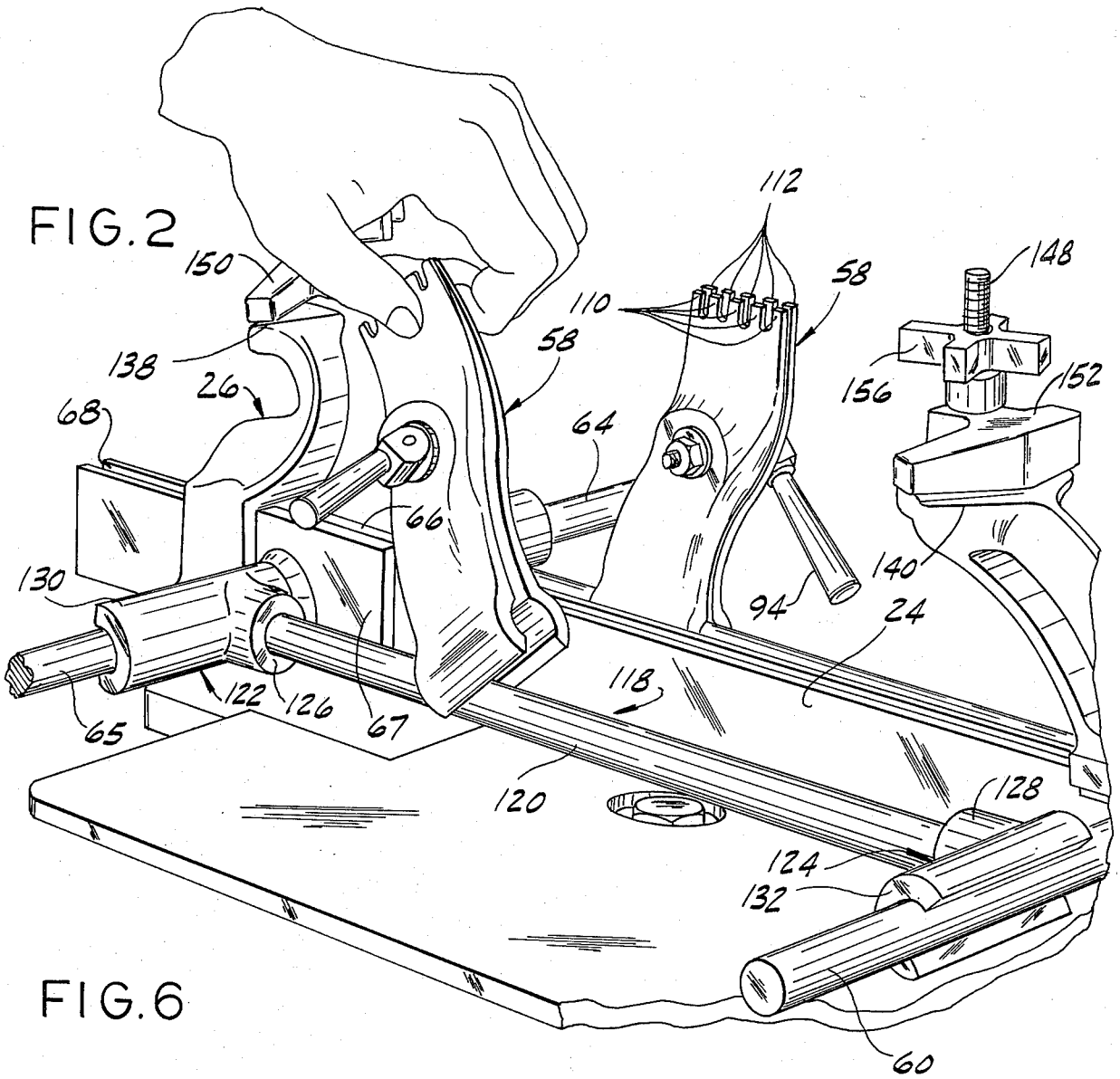
FIG. 2 is an enlarged fragmentary perspective view of the upper portion of the machine of FIG. 1.
Figure 5:
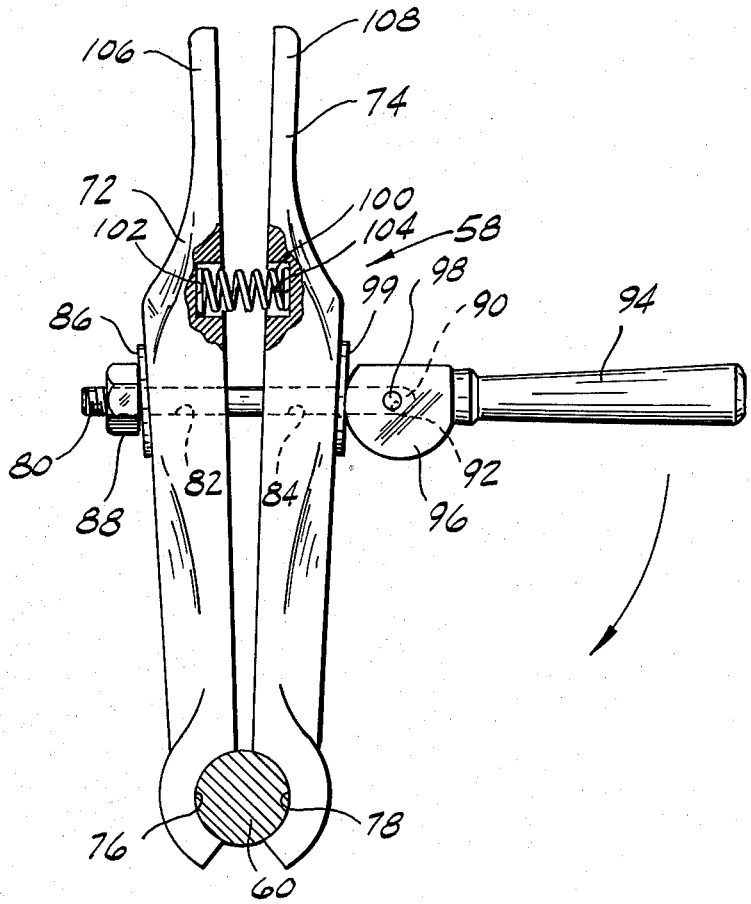
FIG. 5 is a side view of one of the string clamping devices employed on the present machine.

The rods 60, 64 and 65 are included to support the string clamp assemblies 58 which are provided to clamp the individual reaches of string as they are applied to the racket frame in order to maintain the desired tension on the reaches while succeeding reaches are applied and tensioned. The details of one of the clamp assemblies 58 are shown in FIGS. 2 and 5 and are important to the invention. In FIG. 5 the clamp assembly 58 is shown formed by two similar clamp members 72 and 74 which have opposed groove portions 76 near 78 formed near corresponding respective ends. The grooves 76 and 78 are constructed to engage opposite sides of any one of the rods 60, 64 or 65. The clamp members 72 and 74 are held together by a threaded member 80 which extends through aligned bores 82 and 84 therethrough, and the threaded member 80 carries a washer 86 and a lock nut 88 on one end. The opposite or head end of the threaded member 80 has an axially extending rounded portion 90 with a cross-bore or hole 92 therethrough. A handle or operator member 94 having two similar spaced cam portions 96 located on opposite sides of the rounded portion 90 is pivotally attached to the portion 90 by pin 98. The cam portions 96 are slidable on another washer 99 which is positioned on the threaded member 80 as shown. When the handle 94 is in its extended position as shown in FIG. 5, compression spring 100, positioned in opposed cavities 102 and 104 in the members 72 and 74, urges the upper portions 106 and 108 of the clamping members apart. However, when the handle 94 is moved downwardly, the cam portions 96 slide on and against the washer 99 and in so doing move the clamp portions 106 and 108 together in opposition to the force of the spring 100. As can be seen in FIG. 2 the upper ends of the portions 106 and 108 are formed by a plurality of spaced and opposed teeth 110 and 112. The teeth are necessary to enable the clamps to extend into the spaces between spaced reaches of string when holding the tension on string reaches that cross previously applied and tensioned string reaches.

FIG. 2 shows several similar clamp assemblies 58 installed or being installed on rods during a stringing operation albeit rods other than the rods 60, 64 and 65 as will be explained. The installation of each of the clamp assemblies 58 is done with the handle portion 94 in extended position and while holding the upper portions of the clamps as shown. When so held the clamp can be snapped into position on rods such as the rods 60, 64 and 65 in opposition to the force of the spring 100 simply by pressing the clamps against the rod. This makes it very quick and easy to install the clamps 58 and it also makes it equally easy to adjust their positions and to remove them. The compression force of the spring 100 is selected to be sufficient to maintain the clamps in any desired position on the rod to which they are attached even when the string engaging or clamping ends 106 and 108 are somewhat separated to enable a length of string to be positioned between them. This type of string clamp has many advantages over known string clamping devices including substantially simplifying their installation, removal and adjustment, and greatly reducing the time required to locate the clamps in a desired position and to clamp a length of string therebetween. Note that when a string is clamped by moving the handle 94 downwardly, the clamping force is a reaction to the force applied by the clamp members 72 and 74 against the rod on which the clamp 58 is mounted. This is an advantage because it helps to maintain the position of the clamp.

In FIG. 2 the parallel rods 60 and 65 are shown supporting another rod assembly 118 that extends therebetween and which includes another rod 120 connected between similar mounting members 122 and 124 attached to the opposite ends thereof. The mounting members 122 and 124 include portions 126 and 128 which are attached to opposite ends of the rod 120. These portions are connected at right angles to other rod engaging portions 130 and 132 which are constructed to engage the rods 60 and 65 as clearly shown. The rod assembly 118 can be quickly and easily installed on (or removed from) the rods 60 and 65 once the spacing therebetween is properly adjusted. This is done by sliding the rod assembly 118 including the portions 130 and 132 onto the mounting rods 60 and 65 to any desired position thereon depending on the desired location for the string clamps 58 that are to be installed thereon. The purpose of the rod assembly 118 is therefore to enable mounting the clamps 58 in position to clamp reaches of string that extend at right angles across a racket frame to those reaches that are clamped when the clamps 58 are mounted on the rods 60, 64 and 65. The rod 120 is located at or near to the same level as the rods 60, 64 and 65 so that the same clamps 58 can be used to clamp string reaches that extend in both directions. The fact that the rod assembly 118 can be moved back and forth along the rods 60, 64 and 65 enables the teeth 110 and 112 on the clamps 58 to be easily and accurately positioned extending upwardly between spaced string reaches. It is apparent that a rod assembly similar to the rod assembly 118 can be installed on either or both opposite sides of the bar 24 to cover the full range of possible string reaches.

The racket supports 26 and 28 extend upwardly to respective free ends which form means for clamping frame portion 136 of a racket thereto. The means on the supports 26 and 28 against which the racket frame 136 is clamped include rounded surface portions 138 and 140 formed on the upper ends of the respective supports 26 and 28, and rounded frame engaging ridges or shoulders 142 and 144 that extend upwardly from adjacent to the rounded surfaces 138 and 140. Threaded members 146 and 148 extend upwardly from the respective supports 26 and 28, and a similar frame clamp member 150 and 152 is positioned respectively on each of the threaded members 146 and 148. The members 150 and 152 are shaped similarly to the upper surfaces of the supports 26 and 28 and likewise conform to the shape or contour of the racket frame 136.

Figure 7:
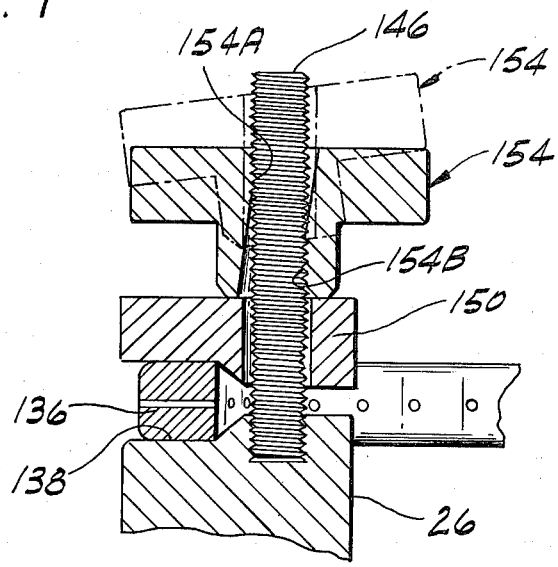
FIG. 7 is an enlarged fragmentary view of a quick release racket clamp mechanism; and, FIG. 8 is a top plan view showing a modified form of string clamp mounting used when stringing rackets that have their crossed string reaches at some angle other than at a right angle.

The threaded members 146 and 148 receive respective knobs 154 and 156 which have partially threaded bores through them. The bores cooperate with the threads on the respective members 146 and 148 in certain positions only of the knobs 154 and 156 as clearly shown in FIG. 7. Special quick release threads are formed in the bores in the members 154 and 156 to reduce the amount of turning that is necessary to clamp or release the frame. A quick release thread is one which becomes engaged or disengaged with relatively little turning motion being required. This permits the members 154 and 146 to become threadedly engaged with the respective members 146 and 148 to apply force to the members 150 and 152 with relatively little turning. When loosened, the members 154 and 156 can be tilted slightly to release the threads altogether so that the members can be slid off of their respective threaded members 146 and 148 (see dotted outline in FIG. 7). The use of quick release fasteners for clamping the racket frame 136 saves considerable time and effort when mounting a racket frame on and removing a racket frame from stringing position. FIG. 7 shows in detail how the quick release members 154 and 156 are constructed and operate, the threaded member 146 is shown extending upwardly from the frame support member 26 and the lower surface of the member 150 is shown in position engaging the racket frame 136. In this condition the quick release member 154 (or 156) is slid down while cocked slightly to engage the upper surface of the member 150, and is then tilted into an upright position to engage threaded portions 154A and 154B with the member 146 (solid outline in FIG. 7). Thereafter, a slight turning of the member 154 will move the upper clamp member 150 against the racket frame 136 to lock it in position for stringing. The process is reversed when the stringing is completed so that the racket can be removed from the machine.

Located near the upper end of the column 14, but below the annular groove 46 for the locking feature, is another horizontal bar 160 that is part of the string tension mechanism. The bar 160 is supported for longitudinal movement between spaced journal means shown as roller pairs 162 and 164. The bar 160 extends from the column 14 on both opposite sides thereof, and one of the bar 160 has attached to it a support member 166 on which a string tensioning clamp assembly 168 is mounted. The clamp assembly 168 may have several different forms including the form of the clamping assembly shown in Halbrook U.S. Pat. No. 4,125,259.

The bar 160 is movable longitudinally between the rollers 162 and 164 and is pivotally connected at a location inside the column 14 to the upper end of a connecting link 170. The link 170 is pivoted to one side of the column 14 at an intermediate location by means of another link 172 and pivots 174 and 176. The lower end of the link 170 has a forked portion 177 which engages a roller 178 on the upper end of projection 179 on pedal lever 180. The pedal lever 180 is pivotally connected to the column 14 at 182, and one end of the lever 180 has a foot pad 184 which is engaged by the operator's foot during operation, and the other end of the lever 180 has a threaded portion 186 which threadedly receives one or more weights 188 and 190 which are positionally adjustable therealong when rotated to determine the amount of tension to be applied to the strings during a stringing operation. The further out on the threaded rod 186 the weights 188 and 190 are located, the greater will be the applied string tension and vice versus.

When the operator depresses the pedal 184 (dotted outline in FIG. 1), the upwardly extending projection 179 and the roller 178 will move the lower end of the link 170 to the left, and this will cause the rod 160 and the clamp assembly 168 attached thereto to move to the right or toward the racket frame. The operator then places the loose string 22 being strung into the clamp assembly 168 making sure that it is clamped as by pulling on the free end. He then takes his foot off the pedal 184 so that the weights 188 and 190 are able to move the right threaded end 186 of the rod 180 downwardly. In so doing the link 170 moves counterclockwise about the pivots 174 and 176 causing the bar 160, and the clamp 168, to move to left applying tension to the string of an amount depending on the location and size of the weights 188 and 190 on the threaded rod portion 186.

Figure 6:
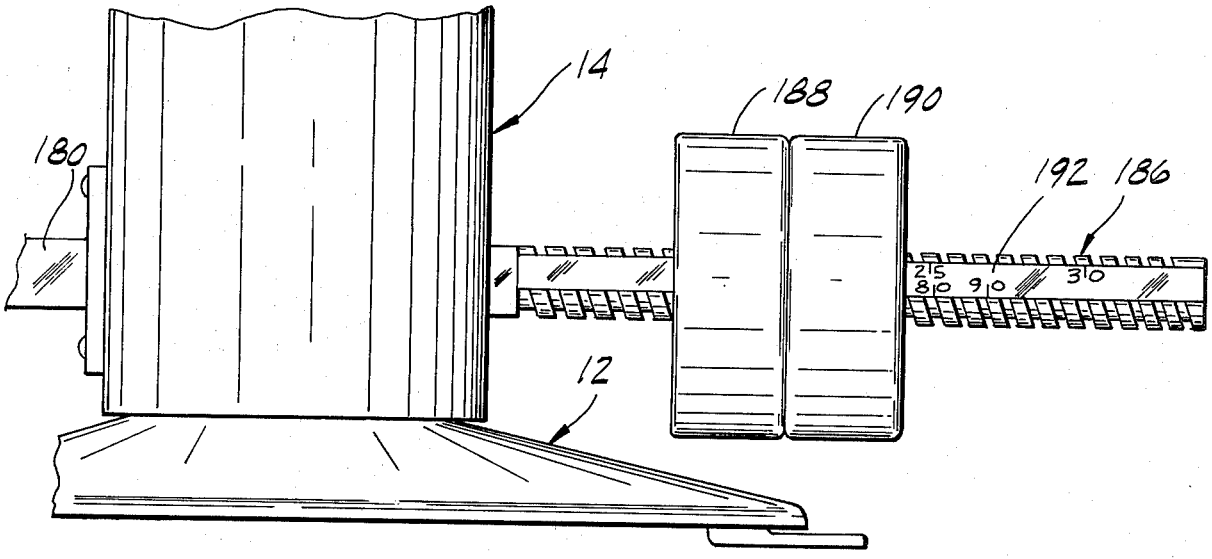
FIG. 6 is an enlarged fragmentary side elevational view of the string tension adjustment means employed on the subject machine.

In the preferred form of the present device the threaded rod portion 186 on which the weights 188 and 190 are located is marked with a graduated scale 191 (FIG. 6) that indicates string tension in the desired weight units depending on the position thereon of the weights 188 and 190. Where two or more weights are used they should be positioned together on the rod portion 186 for the scale to give an accurate reading. It is preferred that the weights 188 and 190 be shaped and constructed so that the operator can rotate them on the threaded rod portion 186 using his foot without having to bend over. This can be facilitated by making the weights rough surfaced.

The rod 180 is also connected to the column 14 by means of dashpot assembly 192 which has a piston portion 194 and a cylinder portion 196. Opposite ends of the dashpot assembly are pivotally connected respectively to the column 14 and to the rod 180 as shown in FIG. 1. The effect of the dashpot assembly 192 on the movement of the rod 180 is adjustable by means of a needle valve adjustment member 198. The adjustment of the needle valve 198 controls the rate of possible movement or damping effect on the rod 180 under control of the weights 188 and 190 when the operator takes his foot off the pedal 184. This prevents sudden applications of force or tension to the string which might occur if the operator should suddenly remove his foot from the pedal or if the operator's foot should slip off the pedal accidentally. This could cause damage to the string. To this end it is preferred that the lower end of the dashpot 192 be connected to the rod 180 outwardly somewhat from the column 14 to provide the greatest possible lever arm for applying the dampening force.

The present stringing machine offers many advantages over stringing machines used in the past including making it easier to install a racket to be strung, making it possible to string many more different kinds, sizes and shapes of rackets, facilitating the installing and removing of the clamp members which maintain the string tension as each reach of string is applied to the racket and tensioned, the present construction makes it more convenient to hold the parts and accessories necessary to a stringing operation, and it provides improved means to adjust the string tension. Furthermore, the present construction includes means to minimize the possibility of damaging the string.

In order to string a racket using the present device, the racket is mounted on upper machine portion 16 as shown in FIG. 1 and made secure. One end of the string is then made secure to the racket frame. The string is then threaded across the frame through the desired frame opening and is tensioned using the clamping member 168 as described above. After the tension is applied, a clamping assembly 58 is mounted on the appropriate bar 60, 64, 65 or 118 and is clamped to the string at a location within the racket frame to retain the string tension, while the succeeding reach is threaded and tensioned. When tensioning the string reaches in one direction across the racket frame, the assembly 118 is positioned extending between the rods 60 and 64 or 65 to support the clamps 58, and when tensioning the string reaches that extend across the racked frame in the other direction the clamps 58 are mounted on the rods 64 and 65 (or 64A and 65A) and possibly also on rod 60. As already indicated, the present stringing machine can be used to string many different kinds of rackets including mid-size tennis rackets, over-sized tennis rackets, deep V tennis rackets, racketball rackets, squash rackets, badminton rackets as well as rackets that have their crossed string reaches oriented at other than a right angle.

Thus there has been shown and described a novel racket stringing machine and components and parts therefor which fulfill all of the objects and advantages sought therefor. It will be apparent to those skilled in the art, however, that many changes, variations modifications and other uses and applications for the subject machines are possible, and also such changes, variations, modifications, and other uses and applications which do not depart from the spirit and scope of the invention are deemed to be covered by the invention which is limited only by the claims which follow.

What is claimed is:

1. In a machine for stringing rackets including a column having a pedestal attached to the lower end thereof and means attached to the upper end for supporting a racket during stringing, said racket support means including a first member fixedly attached to the upper end of the column, a second member mounted for rotation relative to the first member and means for locking said second member in a fixed position relative to the first member, means mounted for movement on said column including string clamping means extending to adjacent a racket to be strung for applying tension to a reach of string attached to the racket frame, means operatively connected to the string clamping means for controlling the position thereof relative to the racket frame including operator actuatable means pivotally attached to the column, the improvement comprising a rod member mounted on the racket support means and a clamp assembly formed by a pair of similar clamp members each having a first portion engageable with the rod member and a second portion extending to adjacent to the racket frame for engaging a reach of string extending across the racket frame, aligned apertures through said clamp members intermediate the ends thereof and an elongated member extending through said aligned apertures, said elongated member having a threaded portion adjacent to one end, a member threadedly engageable with said threaded portion for engaging the clamp member on one side of the clamp assembly, yieldable means positioned between the clamp members urging the second portions thereof apart while simultaneously urging the first portions into engagement with respective opposite sides of the rod member, and an operator member pivotally attached to the elongated member adjacent to the opposite side of the clamp assembly, said operator member having a cam portion thereon and said operator member being movable between a first position substantially perpendicular to the elongated member whereby the cam portion bears against one of the clamp members so that the second portions of the clamp members clampingly engage a reach of string while the first portions of the clamp members simultaneously engage the rod member and a second position substantially aligned with the elongated member whereby the cam portion allows the second portions of the clamp members to move apart sufficient so that the clamp assembly is in non-string clamping condition and the first portions remain engaged with the rod member under pressure of the yieldable means, said second portions being movable toward each other in the second position of the operator member and in opposition to the yieldable means whereby the first portions are able to be moved apart sufficiently to enable separation from the rod member.

2. In the machine of claim 1 wherein the machine includes at least two spaced apart rod members and an auxiliary rod assembly mounted extending between and supported by said spaced apart rod members, the first portion of said clamp assembly being alternatively engageable with said auxiliary rod assembly.

3. In the machine of claim 1 including at least two angularly oriented rod members on the racket support means.

4. In the machine of claim 1 including means on the racket support means for clamping a racket in stringing position thereon, said racket clamp means including first and second cooperatively engageable threaded members, the first of which has a bore with axially displaced opposed threaded portions and axially displaced non-threaded portions formed therein, said non-threaded portions being substantially parallel and acutely inclined relative to the axis of the bore, said first member being angularly movable relative to the axis of the bore and relative to the second threaded member between a first position in which the first and second members are threadedly engaged and a second position in which the first member is out of threaded engagement with the second member.

5. An assembly for clamping a reach of string being strung on a racket frame mounted on a racket stringing machine to maintain the tension thereon, the machine having a mounting bar for supporting the clamping assembly in position extending to adjacent to the racket frame comprising a pair of similar elongated string clamp members each having opposed first and second opposite end portions, each of said first end portions having a string engaging surface formed thereon and each of said second end portions having a mounting bar engaging surface formed thereon, an aperture extending through each of the clamp members at an intermediate location therealong, a connection member extending through the apertures when the apertures are in registration, spaced means on the connection member engageable respectively with the clamp members to hold the clamp members together including an operator member pivotally attached adjacent to one end of the connection member for angular movement toward and away from the string clamp members, said operator member having a cam surface thereon operatively engageable with one of the clamp members, yieldable means engageable with the clamp members on one side of the connection member for urging apart the first end portions thereof while simultaneously urging the second portions together into engagement with a mounting bar positioned therebetween, said operator member being movable between a first position substantially perpendicular to the elongated member and parallel to the plane of the clamp members whereby the cam surface moves the first end portions of the clamping members together in opposition to the yieldable means while simultaneously urging the bar engaging surfaces on the second end portions thereof against opposite sides of the mounting bar on the stringing machine, and a second position substantially aligned with the elongated member and normal to the clamp members wherein the cam surface permits the yieldable means to separate the first end portions while maintaining the second end portions engaged with the mounting bar in a clamping condition under pressure of the yieldable means, said first portions being movable toward each other in the second position of the operator member and in opposition to the yieldable means to enable the second portions to be separated sufficiently so that the assembly can be removed from the mounting bar.

6. The clamp assembly of claim 5 wherein said connection member includes a rod member extending through the registered apertures in the clamp members, said rod member having a threaded portion adjacent the end thereof opposite from the operator member, and means threadedly engageable therewith for engaging one of the clamp members, said means threadedly engageable therewith being adjustable thereon to control the force exerted on a string positioned between the first end portions of the clamp members when the operator member is in the first position.

7. The clamp assembly of claim 5 wherein the bar engaging surfaces on the second end portions of the clamp members are spaced apart sufficiently when the operator member is in the second position to enable the second end portions of the clamp members to separate sufficiently in opposition to the force of the yieldable means so that the clamp assembly can be removed from the mounting bar.

8. The clamp assembly of claim 5 wherein the first end portions of the clamp members include a plurality of spaced endwardly extending tooth portions.

9. A clamp assembly for clamping string reaches during a racket stringing operation to maintain string tension thereon comprising a pair of similar clamp members each having first and second opposite end portions and an aperture therethrough at an intermediate location, an elongated member extending through the apertures in said clamp members when the apertures are in registration, said elongated member having a threaded portion adjacent one end for receiving a threaded member thereon for operatively engaging one of the pair of clamp members and an operator member pivotally connected adjacent to the opposite end of the elongated member, said threaded member being adjustable on the elongated member to determine the string tension, a yieldable member positioned extending between the clamp members on one side of the elongated member to urge the first end portions thereof apart while simultaneously urging the second end portions thereof toward each other, a mounting surface on the second end portion of each clamp member, the mounting surfaces on the respective clamp members being in spaced opposed relation to engage a support member extending therebetween under pressure of the yieldable member, said operator member having a cam portion operatively engageable with one of said clamp members and movable with the operator member between a first position substantially perpendicular to the elongated member whereby the first end portions of the clamp members move together into string clamping position and the second end portions of the clamp members move together clamping the support member therebetween and a second position substantially aligned with the elongated member whereby the yieldable member urges the first end portions of the clamp members apart while maintaining the second end portions of the clamp members in clamping engagement with the support member therebetween, said first portions being movable toward each other in the second position of the operator member and in opposition to the yieldable member whereby the second portions are able to be moved apart sufficiently to enable separation of the clamp assembly from the support member.

10. Means for clamping reaches of string on a racket frame during a racket stringing operation where the racket frame is constructed to support first and second groups of parallel string reaches, the reaches in the first group being angularly oriented relative to the reaches in the second group comprising means to support a racket frame to be strung, means engageable with each string reach as it is applied to the frame including means to apply tension thereto, means to maintain the tension applied to each reach as the succeeding reach is applied to the frame and tensioned to maintain the tension thereon, said last named means including a first and second rod-like support member mounted on the racket support means in spaced relation to the frame being strung, said first rod-like support member being oriented parallel to the plurality of string reaches in the first group and the second rod-like support member being oriented parallel to the plurality of string reaches in the second group, and a clamp assembly including a pair of similar clamp members each having a first end portion for engaging a reach of string to be clamped therebetween and a second end portion for simultaneously engaging one of the first and second rod-like support members, said clamp members having registered openings therethrough intermediate between their first and second end portions, an elongated member extending through the registered openings, means adjacent one end of the elongated member for operatively engaging the clamp assembly on one side thereof, means on one side of the registered openings biasing the clamp members apart, and operator means including an operator member pivotally attached adjacent to the opposite end of the elongated member, said operator member being pivotally attached adjacent to the opposite end of the elongated member, and having a cam portion thereon operatively engageable with the clamp assembly opposite said means adjacent one end of the elongated member, said cam portion being movable with the operator member between a first position in which the operator member is substantially perpendicular to the elongated member clamping the first portions of the clamp members together on a reach of string positioned therebetween while simultaneously urging the second portions of the clamp members against opposite sides of the rod-like support member and a second position in which the operator member is substantially aligned with the elongated member wherein the first portions of the clamp members move out of clamping engagement with the reach of string while the second portions are held in clamping engagement with the rod-like support member under pressure of the biasing means, said first portions being movable toward each other in the second position of the operator member in opposition to the biasing means whereby the second portions are able to be moved apart sufficiently to enable clamp assembly removal from and installation on one of the rod-like support members.

11. The means for clamping defined in claim 10 wherein the first and second rod-like support members are oriented at right angles.

12. The means for clamping defined in claim 10 wherein the first and second rod-like support members are acutely angularly oriented.

* * * * *

UNITED STATES PATENT OFFICE

CERTIFICATE OF CORRECTION

Patent No. 4,366,958 Dated January 4, 1983

Inventor(s) Warren Bosworth

It is certified that error appears in the above-identified patent and that said Letters Patent are hereby corrected as shown below:

Column 5, line 55 "146" should be --156--.

Column 5, line 67 "operate, the" should be --operate. The--.

Column 6, line 20 "one of" should be --one end of--.

Signed and Sealed this

*Fifteenth* Day of *March 1983*

[SEAL]

*Attest:*

GERALD J. MOSSINGHOFF

*Attesting Officer*

*Commissioner of Patents and Trademarks*